US005811723A

United States Patent [19]

Stone

[11] Patent Number: 5,811,723

[45] Date of Patent: Sep. 22, 1998

[54] SOLID COPPER HOLLOW POINT BULLET

[75] Inventor: Jeffrey W. Stone, Elizabethtown, Ky.

[73] Assignee: Remington Arms Company, Inc., Madison, N.C.

[21] Appl. No.: 869,690

[22] Filed: Jun. 5, 1997

[51] Int. Cl.[6] ..... F42B 12/34

[52] U.S. Cl. ..... 102/509; 102/522

[58] Field of Search ..... 102/439, 448, 102/501, 507–510, 520–523

[56] References Cited

U.S. PATENT DOCUMENTS

| | | | |
|---|---|---|---|
| 2,045,964 | 6/1936 | Rinkel | 102/509 |
| 3,157,137 | 11/1964 | Burns, Jr. | 102/509 |
| 4,655,140 | 4/1987 | Schirneker | 102/508 |
| 5,131,123 | 7/1992 | Brooks | 29/1.2 |
| 5,208,424 | 5/1993 | Schluckebier et al. | 102/509 |
| 5,259,320 | 11/1993 | Brooks | 102/509 |
| 5,339,743 | 8/1994 | Scarlata | 102/439 |
| 5,357,866 | 10/1994 | Schluckebier et al. | 102/509 |
| 5,385,101 | 1/1995 | Corzine et al. | 102/509 |
| 5,515,787 | 5/1996 | Middleton | 102/509 |

FOREIGN PATENT DOCUMENTS

| | | | |
|---|---|---|---|
| 80057 | 3/1868 | France | 102/501 |
| 3822775 | 2/1990 | Germany | 102/507 |
| 3840165 | 7/1990 | Germany | 102/510 |

*Primary Examiner*—Harold J. Tudor
*Attorney, Agent, or Firm*—Huntley & Associates

[57] ABSTRACT

A solid copper hollow point bullet is disclosed wherein the effective expansion is about two times the original diameter. Over expansion and curling under of the petals formed upon impact with a target media is minimized and controlled by external stress risers and hollow point cavity geometry.

4 Claims, 4 Drawing Sheets

SOLID COPPER HOLLOW POINT BULLET

BACKGROUND OF THE INVENTION

This invention relates to a solid copper hollow point bullet.

Mushrooming hollow point bullets are known in the art. Schluckebier, U.S. Pat. No. 5,357,866 discloses a jacketed hollow point bullet having a lead core and a brass jacket that terminates at the edge of the opening in the core forming the hollow point. Slits are formed through the jacket and the core at the edge of the core opening so that the core and jacket petals formed when mushrooming separate, with the jacket petals expanding more than the core petals. Brooks, U.S. Pat. No. 5,259,320 discloses a hollow point bullet consisting essentially of a single member formed from a single piece of material. The hollow point of this bullet has a terminal peripheral edge of an undulating configuration, but there are no slits cut completely through the hollow point wall. Shot gun slugs, marketed by Remington Arms Company under the name "Premier® Copper Solid™ Sabot Slugs", have a hollow point where the surface at the bottom of the hollow point has a sharp edge.

One problem experienced with hollow point bullets previously known is that the petals formed upon impact continue to deform toward the base of the bullet. With the shot gun slugs described above, the petals formed on impact with a target media eventually separate from the slug as it passes through the target media, reducing the weight of the slug. Both the excessive deformation of the petals and the separation of petals from the slug reduce the trauma in the target media.

SUMMARY OF THE INVENTION

The present invention provides a hollow point bullet which results in excellent expansion characteristics.

Specifically, the present invention provides a solid copper hollow point bullet comprising a body having a base portion and a nose portion, the nose portion having a wall having at least a forward edge and the base portion having at least a forward surface, the improvement comprising a plurality of rearwardly projecting spaced slits, each slit having a forward and rearward end, extending through the wall from the forward edge, to form spaced petals having first and second edges at least one of the first and second edges extending inwardly from the wall and the forward surface having a substantially concave shape.

DETAILED DESCRIPTION OF THE INVENTION

The present invention will be more fully understood by reference to the Figures, in which like elements are identified by like numbers.

Figure 1A:
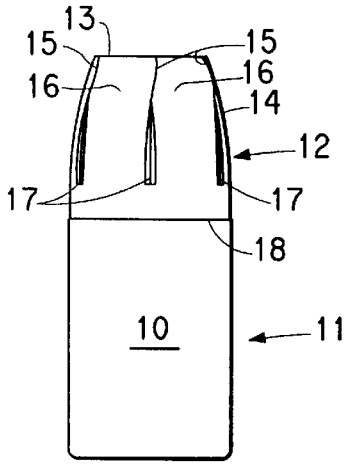
FIG. 1A is a side view of a bullet according to one embodiment of the present invention.

As shown in FIG. 1A, bullet 10 consists of a base portion 11 and a nose portion 12. The nose portion has a generally outwardly convex profile. The nose portion 12 of the bullet 10 terminates in a forward edge 13 with a wall 14 surrounding a central recess, or hollow point. Slits 15 are cut through the wall 14 and extend into the hollow point, with the portions of the wall between each slit forming petals 16 of wall material.

Figure 1B:
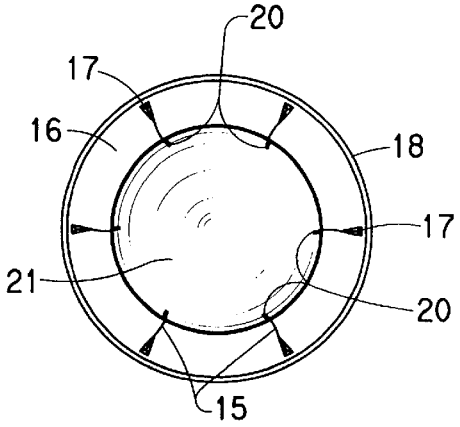
FIG. 1B is an enlarged end view of a bullet according to one embodiment of the present invention.

One edge 20 of each petal 16 of wall material is folded into the central recess 21 as shown in FIG. 1B. This results in overlapping petals, somewhat similar to a camera shutter. Because the slits 15 pass completely through the wall 14 into the central recess 21 of the nose portion 12, the initial failure points are established, leading to uniform and consistent expansion. This enhances the performance of the bullet at lower velocity levels.

The bullet can be made from copper and copper alloys. Specifically, by copper is meant substantially pure copper and copper alloys with minor quantities of other components which do not alter the basic performance characteristics, including, for example, up to about 35% zinc, and up to about 3% of other components. Such other components, when present, can be selected from zirconium, magnesium, phosphorus, silver, beryllium, cobalt and iron.

Representative alloys which can be used, as identified by the Copper Development Association (CDA) are alloy numbers:

| | | | |
|---|---|---|---|
| C10200 | C11600 | C17400 | C24000 |
| C10400 | C12200 | C18200 | C26000 |
| C10500 | C14500 | C19400 | C26800 |
| C10700 | C14700 | C21000 | C27000 |
| C11000 | C15000 | C22000 | |
| C11300 | C15500 | C22600 | |
| C11400 | C17200 | C23000 | |

Figure 1C:
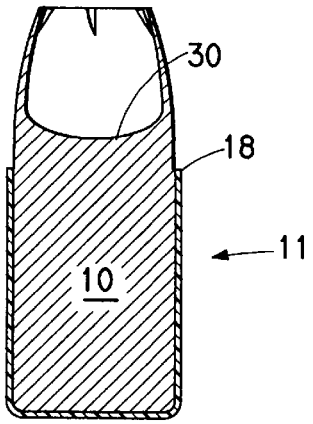
FIG. 1C is a cross-sectional view of a bullet according to one embodiment of the present invention.

Particularly preferred is oxygen free copper, such as that commercially available as CDA#C10200. The center of mass of the bullet is biased toward the base portion 11, thereby improving the dynamic and gyroscopic stability. As seen in FIG. 1C, the forward surface 30 of the base portion 11 has a substantially concave shape. This concave surface geometry reduces or eliminates the separation of the petals from the slug providing for nearly 100% projectile weight retention upon impact with target media.

In a preferred embodiment, the bullet has grooves 17 formed on the outside of the wall 14 as shown in FIG. 1A. These grooves 17 extend from the rearward end of each slit 15 toward the base portion 11. The grooves function as stress risers that allow for the continued expansion or tearing of the wall 14 upon impact in a target media. The thickness of the wall 14 is increased from the forward edge 13 toward the base portion 11. This increasing thickness is preferably nonlinear, i.e., the thickness changes at a nonconstant rate. By varying the thickness of the wall 14 in this manner, the expansion of the nose portion 12 of the bullet 10 upon impact with a target media is maximized because over expansion and curling under of the petals 16 is minimized. The internal geometry of the hollow point cavity retards over expansion in the target media.

The bullet 10 is also preferably provided with a ridge 18 as shown in FIGS. 1A and 1B. Ridge 18 is designed to mate with a lip formed on the inside of a sabot to form a mechanical interlock.

Figure 2A:
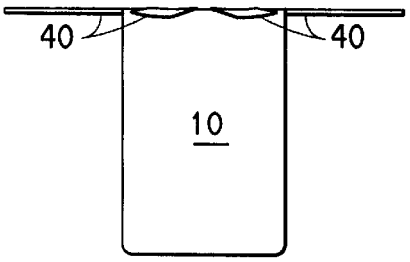
FIGS. 2A and 2B are side and end views, respectively, of a bullet according to the present invention after impact with a target media.
Figure 2B:
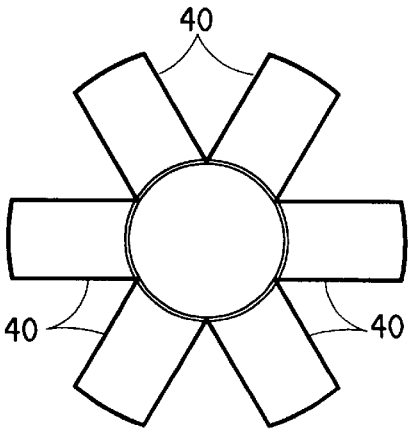

Upon impact in a target media, the wall 14 tears at the location of each of the slits 15, forming outwardly projecting petals of wall material. Because the slits 15 are cut completely through the wall 14, the petals initially open sooner, increasing the damage to the target media. As seen in FIG. 2A, the wall 14 tears or deforms until the petals 40 are substantially perpendicular to the longitudinal axis of the bullet 10. This results in maximum expansion of the effective diameter of the bullet 10, providing for maximum damage and trauma to the target media. FIG. 2B shows an end view of a bullet 10 after impact with a target media. The typical expansion of a bullet according to the present invention is about two times the original diameter.

The process for manufacturing a bullet of the present invention will be described with reference to FIGS. 3A through 3F.

Figure 3A:
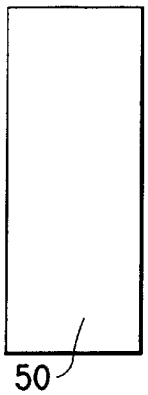
FIGS. 3A–3F illustrate the process for manufacturing a bullet according to the present invention.
Figure 3B:
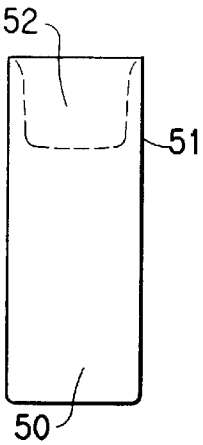
Figure 3C:
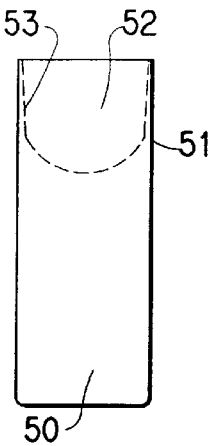

The process begins with a bullet blank 50, as shown in FIG. 3A, which is solid copper alloy stock that can be cast or cut from a drawing rod. The bullet blank 50 is placed into a first forming die (not shown). As shown in FIG. 3B, central recess 52 is formed into the nose area 51 by using an extrusion punch (not shown). As shown in FIG. 3C, the wall 53 surrounding central recess 52 is formed to a tapered angle by using a stationary die and coining punch (not shown). By selecting the coining punch appropriately, the internal profile of the nose area 51 can be formed to any given geometry.

Figure 3D:
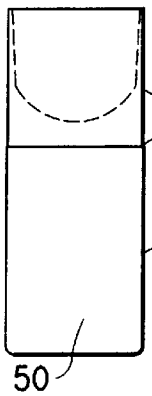

As shown in FIG. 3D, the diameter of the base portion 54 is increased by containing the nose area 51 within a punch and sliding the die. By increasing the diameter of the base portion 54 relative to the nose portion 51, a ridge 55 is formed around the circumference of the bullet blank. Ridge 55 is designed to interlock with a lip inside a sabot (not shown), thereby holding the bullet and the sabot together during handling.

Figure 3E:
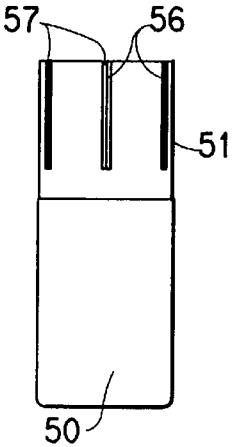
Figure 3F:
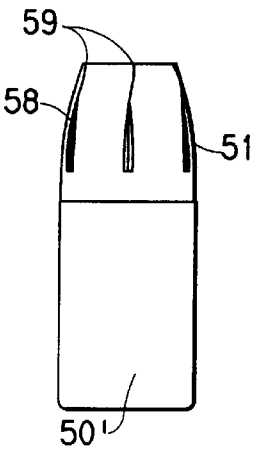

FIG. 3E shows the detail of bullet blank 50 after the outside diameter of the nose is scored and the tip of the nose cut. Scoring marks 56 are spaced circumferentially around nose portion 51. At the forward most end of the scoring marks 56 short cuts 57 are made. The process of cutting the nose portion 51 is completed by moving bullet blank 50 into a punch assembly (not shown). In this operation score marks 56 are impressed into nose portion 51 to form grooves 58 as shown in FIG. 3F. A nose cutting insert (not shown) cuts completely through the wall of nose portion 51 and forms cuts 59, shown in FIG. 3F. The nose cutting process facilitates curling the flaps inwardly on the nose portion of the projectile.

Bullet blank 50 is then finish formed wherein the final profile of nose portion 51 is formed as well as the final diameter of bullet blank 50 being sized. The finished form bullet 50' is illustrated in FIG. 3F.

After bullet 50' is finished formed, it can be annealed to soften the copper. This annealing process can be used to adjust the softness of the copper material, thereby providing a method for modifying the expansion characteristics of the bullet by adjusting the metallurgical properties of the copper material.

Figure 4:
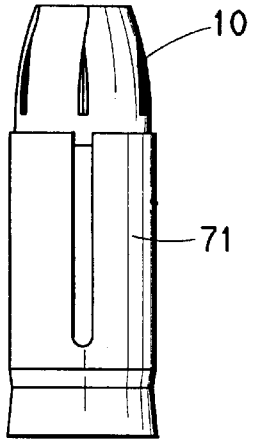
FIG. 4 shows a bullet inside a sabot, according to one embodiment of the present invention.
Figure 6:
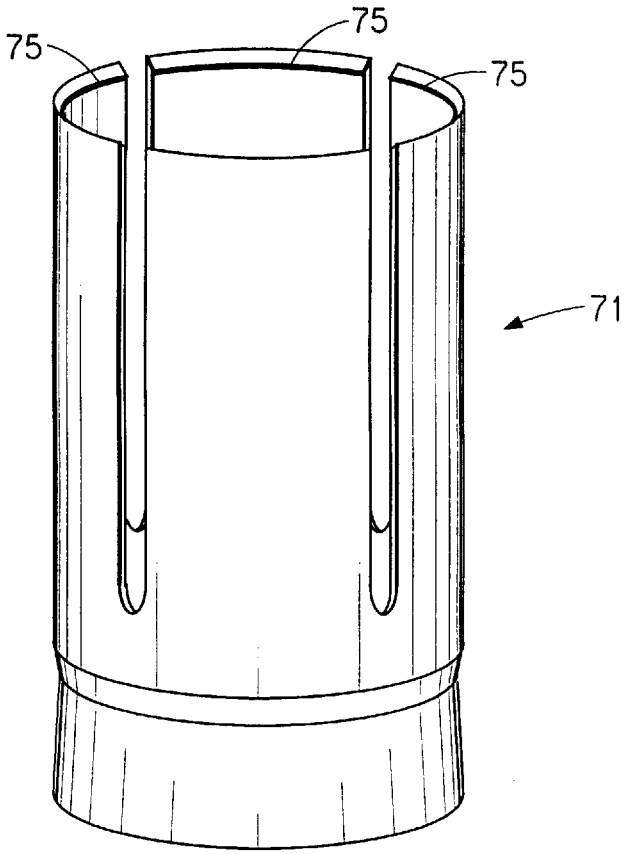
FIG. 6 is a perspective view of a sabot, according to one embodiment of the present invention.

FIG. 4 shows a bullet 10 inside a sabot 71, according to one embodiment of the present invention. In FIG. 6, lip or rim 75 is formed on the inner surface of sabot 71. Rim 75 is designed to form a mechanical interlock with ridge 18 of the bullet.

Figure 5:
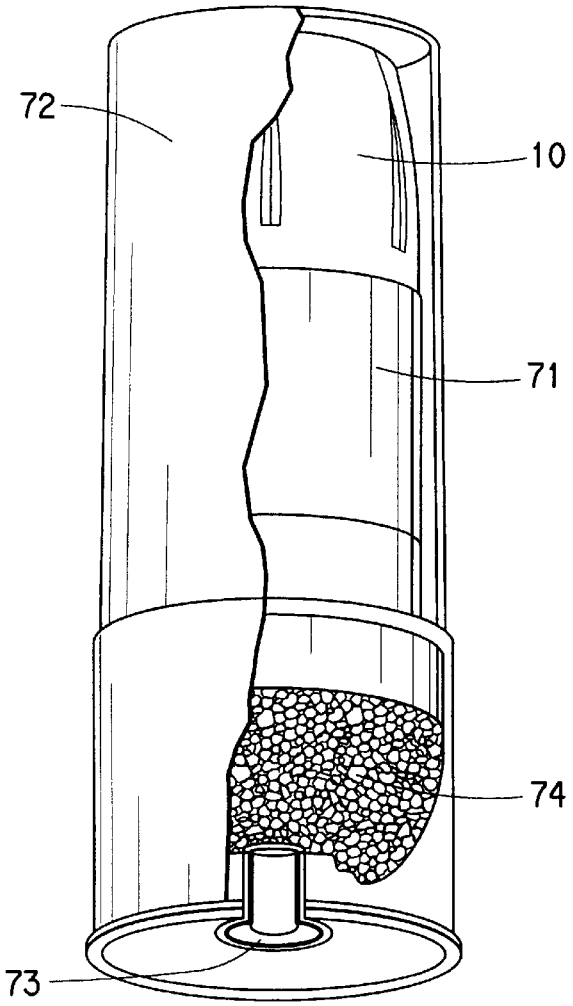
FIG. 5 is a cross-sectional illustration of a bullet of the invention in a shotshell casing.

The bullets of the present invention are particularly well suited for use in a muzzle loading firearm or a modern shotshell casing. The caliber of typical bullets for such applications ranges about from 0.35 to 0.50 with a sabot of 0.45, 0.50 or 0.54 caliber or a shotshell of 0.410, 28, 20, 16, 12, or 10 gauge. The ballistic coefficient of the bullet is in the range of about from 0.19 to 0.21. When used in a shotshell casing, the bullet is generally placed in a sabot, which is within a casing that also includes a primer and powder charge. Such a product is shown in FIG. 5, in which bullet 10 is in sabot 71. The sabot in is shotshell casing 72, which includes primer 73 and powder charge 74.

The combination of material choice and nose portion geometry provide for excellent expansion characteristics. The outwardly projecting petals of wall material, formed upon impact with a target media, deform until they project at a substantially 90° angle relative to the longitudinal axis of the bullet. This expansion maximizes the potential from the existing hollow point cavity. The typical expansion of a bullet according to the present invention is about two times the original diameter.

I claim:

1. In a non-jacketed, one-piece, solid copper hollow point bullet comprising a body having a base portion and a nose portion, the nose portion having a wall having at least a forward edge and the base portion having at least a forward surface and an outer surface, the improvement comprising a plurality of rearwardly projecting spaced slits, each slit having a forward and and a rearward end, extending through the wall from the forward edge, to form spaced petals having first and second edges at least one of the first and second edges extending inwardly from the wall, a plurality of grooves on the outside surface of the wall, each groove extending rearwardly from the rearward end of each slit toward the base portion and the forward surface having a substantially concave shape.

2. A bullet of claim 1 wherein the thickness of the wall increases from the opening toward the base portion.

3. A bullet of claim 1 further comprising a sabot.

4. A bullet of claim 3 wherein the bullet further comprises a ridge on the outer surface thereof and the sabot further comprises a rim on an inner surface thereof, the ridge and the rim forming an interlock.

* * * * *